US008296991B1

(12) United States Patent
Chung

(10) Patent No.: US 8,296,991 B1
(45) **Date of Patent: *Oct. 30, 2012**

(54) DIGITAL MACHINEGUN OPTIC WITH BULLET DROP COMPENSATION MOUNT

(75) Inventor: Sung Giu Chung, McLean, VA (US)

(73) Assignee: International Trade and Technologies, Inc., McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/436,366

(22) Filed: Mar. 30, 2012

Related U.S. Application Data

(63) Continuation-in-part of application No. 13/304,082, filed on Nov. 23, 2011, now Pat. No. 8,186,093, which is a continuation-in-part of application No. 13/179,154, filed on Jul. 8, 2011.

(60) Provisional application No. 61/565,387, filed on Nov. 30, 2011.

(51) Int. Cl.
*F41G 1/00* (2006.01)
*F41G 1/30* (2006.01)

(52) U.S. Cl. ..... 42/111; 42/113

(58) Field of Classification Search ..... 42/111, 42/113, 122, 123, 130
See application file for complete search history.

(56) References Cited

U.S. PATENT DOCUMENTS

| | | | | |
|---|---|---|---|---|
| 5,625,954 | A * | 5/1997 | DePaoli | 42/113 |
| 7,832,137 | B2 * | 11/2010 | Sammut et al. | 42/111 |
| 8,186,093 | B1 * | 5/2012 | Chung | 42/113 |
| 2007/0044364 | A1 * | 3/2007 | Sammut et al. | 42/122 |
| 2007/0068018 | A1 * | 3/2007 | Gilmore | 33/265 |
| 2009/0064514 | A1 * | 3/2009 | Roes | 33/227 |
| 2010/0275495 | A1 | 11/2010 | Jung et al. | |

* cited by examiner

*Primary Examiner* — Bret Hayes
(74) *Attorney, Agent, or Firm* — Birch, Stewart, Kolasch & Birch, LLP

(57) ABSTRACT

A digital machinegun optic (DMO) is discussed, which includes a digital module having a camera to obtain an image, a bullet drop compensation mount receiving the digital module in a detachable manner, and having a mounting solution, a caliber adjustment knob configured to enable a user to select a caliber that matches firearms of different calibers, and a dual bullet drop compensation wheel to allow the user to accurately hit a target by selecting a right distance to the target; a head mounted display module having a display portion to receive the image from the camera; and a control box module configured to control a display of the image on the display portion.

9 Claims, 20 Drawing Sheets

DIGITAL MACHINEGUN OPTIC WITH BULLET DROP COMPENSATION MOUNT

CROSS REFERENCE TO RELATED APPLICATIONS

This application claims the benefit of U.S. provisional application No. 61/565,387 filed on Nov. 30, 2011, and also is a continuation-in-part of U.S. application Ser. No. 13/304,082 filed on Nov. 23, 2011 now U.S. Pat. No. 8,186,093, which in turn is a continuation-in-part of co-pending U.S. application Ser. No. 13/179,154 filed on Jul. 8, 2011, the disclosures of each of which are incorporated by reference.

BACKGROUND OF THE INVENTION

1. Field of the Invention

Embodiments of the invention relate to a sight device that is designed and built for firearms, especially heavy and medium size machine guns, for the purpose of all armed forces, hunters, and police departments. A sight device offers a very large field of view design that provides rapid target acquisition for both stationary and moving targets. In addition, a sighting device also provides pin-point accuracy, which ensures every round is on target to ultimately suppress enemies faster, reduce collateral damage, and conserve ammunition. To provide such pin-point accuracy, a digital machinegun optic (DMO) comes with a bullet drop compensation mount (BDCM), which allows shooters to install the mount easily and quickly to any firearms, such as medium and heavy machineguns. The digital machinegun optic (DMO) can be easily and quickly converted into a universal machinegun optic (a red dot sight) and/or an all weather machinegun optic (a thermal sight) due to its modular design.

2. Discussion of the Related Art

Iron sights are commonly used by shooters for aiming firearms such as rifles, or medium and heavy machine guns. Each iron sight requires the shooter to align a rear and front sights of a rifle along with the target, which requires trainings and shooting skills.

Dot sights were developed for the purpose of offering rapid target acquisition of both stationary and moving targets with limited training. A sight can easily convert non-experienced shooter into a skilled marksman. A sight is also commonly known as a non-magnifying reflector (or reflex) sight that is mounted on firearms to provide the shooter an aiming indication in the form of a red dot or a red dot with a circle. Sights are designed and developed to offer shooters, such as sportsmen, hunters, policemen and soldiers the ability to acquire and engage target or targets quickly and effectively. Sights are user friendly devices in the sense that it only requires the shooter to aim the red dot on the target and upon pulling the trigger, a projectile will impact the point of aim.

A dot sight comes with a red light-emitting diode (LED) at the focus of the collimating optics to generate a light that is visible to the human eye. A visible dot remains parallel to a bore of the firearm no matter what position the human eye is in relative to the dot sight.

A dot sight can also use an infrared light source at the focus of the collimating optics to generate a light that is invisible to the human eye. By using an IR coating technology, an illuminated reticle will then be visible at the lens that stays in alignment with the weapon. The dot sight then may be attached to the weapon regardless of eye position (i.e., parallax free).

A very large field of view design enables the shooter to keep both eyes open during operation to enable an unlimited field of view at any distance. The eye relief is also unlimited, which means that the shooter's eye position behind the sight does not affect how well the shooter sees the target.

Shooting with both eyes open offers the shooter enhanced situational awareness to allow the possibility to deal with multiple targets. A dot sight helps a shooter become an effective marksman offering ability to aim accurately and quickly under any extreme or stressful conditions.

SUMMARY OF THE INVENTION

An object of an embodiment of the invention is to provide an aiming device that offers the shooter capabilities to engage single or multiple targets as quickly as possible while delivering accuracy in a user-friendly device.

Another object of an embodiment of the invention is to provide a bullet drop compensation mount to be used with various firearms, such as various medium and large size machineguns.

Another object of an embodiment of the invention is to provide shooters options to install any commonly available aiming devices such as a dot sight device, a day and night camera, an illuminator, and a thermal camera on top of the bullet drop compensation mount in order to allow the shooters to engage a target or targets effectively and accurately using a dual bullet drop compensation wheel. Upon confirmation of a distance to a target of interest, a shooter can engage it with pin-point accuracy just by rotating the dual bullet drop compensation wheel that allows a selection of a distance, for example, from 100 m to 2000 m.

Another object of an embodiment of the invention is to easily convert the bullet drop compensation mount into a digital machinegun optic (DMO) by installing a digital module. The digital module includes a rugged camera and an infrared (IR) illuminator. The camera is a device that obtains image data from an object by converting light from the object into the image data by using an image capturing sensor, such as a charge-coupled device (CCD) and an active pixel sensor. The camera may have a reticle to help the shooters to engage targets quickly and accurately. The IR illuminator may automatically activate to provide visibility during a night operation. A plurality of rails may be installed to the DMO in order to install other devices such as laser pointers, dazzler lasers, flash lights, laser range finders, night vision devices, and thermal cameras thereto.

Another object of an embodiment of the invention is to provide a DMO that may be used to aim at targets during any day and night operations.

Another object of an embodiment of the invention is to provide the DMO that may be used with various caliber arms. The DMO can be used with multiple firearms as it comes with multiple ballistic drop compensation wheels (5.56 mm and 7.62 mm, 7.62 mm and 12.7 mm, and 12.7 mm and 20 mm). One DMO may be used with multiple firearms with different ballistics.

Another object of an embodiment of the invention is to provide a DMO that can receive target distance information (100 m-2000 m) and easily control a bullet drop compensation wheel for quick, easy, and accurate target acquisition.

Another object of an embodiment of the invention is to provide a bullet drop compensation mount that is designed to allow easy and quick installation to firearms, such as medium and heavy machineguns without a special tool or wrench, since tools used to install sights are usually lost during training and deployments.

Another object of an embodiment of the invention is to easily convert the bullet drop compensation mount into a universal machinegun optic (UMO) by installing an optical module or a red dot sight. A plurality of rails may be installed on the universal machinegun optic (UMO) in order to install other devices such as laser pointers, dazzler lasers, flash lights, laser range finders, night vision devices, and thermal cameras thereto.

Another object of an embodiment of the invention is to provide a universal machinegun optic (UMO) having capability to engage and aim at targets during any day and night operations.

Another object of an embodiment of the invention is to provide a dot sight device that is able to automatically control a brightness of a targeting dot.

Another object of an embodiment of the invention is to easily convert the bullet drop compensation mount into an all weather machinegun optic (AWMO) by installing any commonly available thermal camera module. A plurality of rails may be installed to the thermal camera module that allows the installation of other devices such as laser pointers, dazzler lasers, flash lights, laser range finders, and night vision devices thereto.

Another object of an embodiment of the invention is to provide an all weather aiming device that may be used to aim at targets during any weather operations.

Additional features and advantages of this invention will be set forth in the description which follows, and in part will be apparent from the description, or may be learned by practice of this invention. The objectives and other advantages of this invention will be realized and attained by the structure particularly pointed out in the written description and claims thereof as well as the appended drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
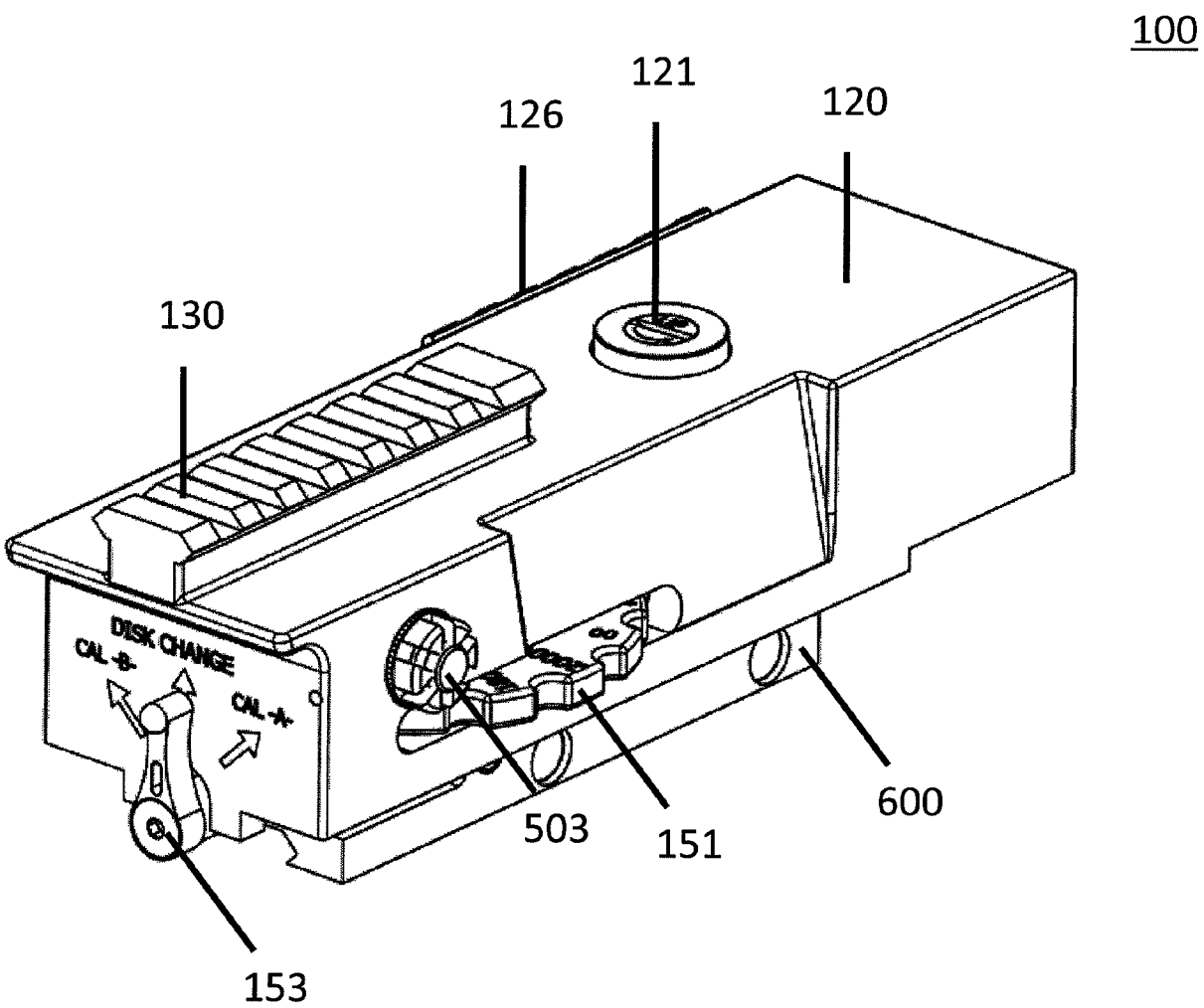
FIG. 1 shows a perspective view of a left front side of a bullet drop compensation mount (BDCM) according to an example embodiment of the invention.

Hereinafter, example embodiments of this invention will be described in detail with reference to FIGS. 1-20. Like reference numerals designate like elements throughout the specification.

Figure 2:
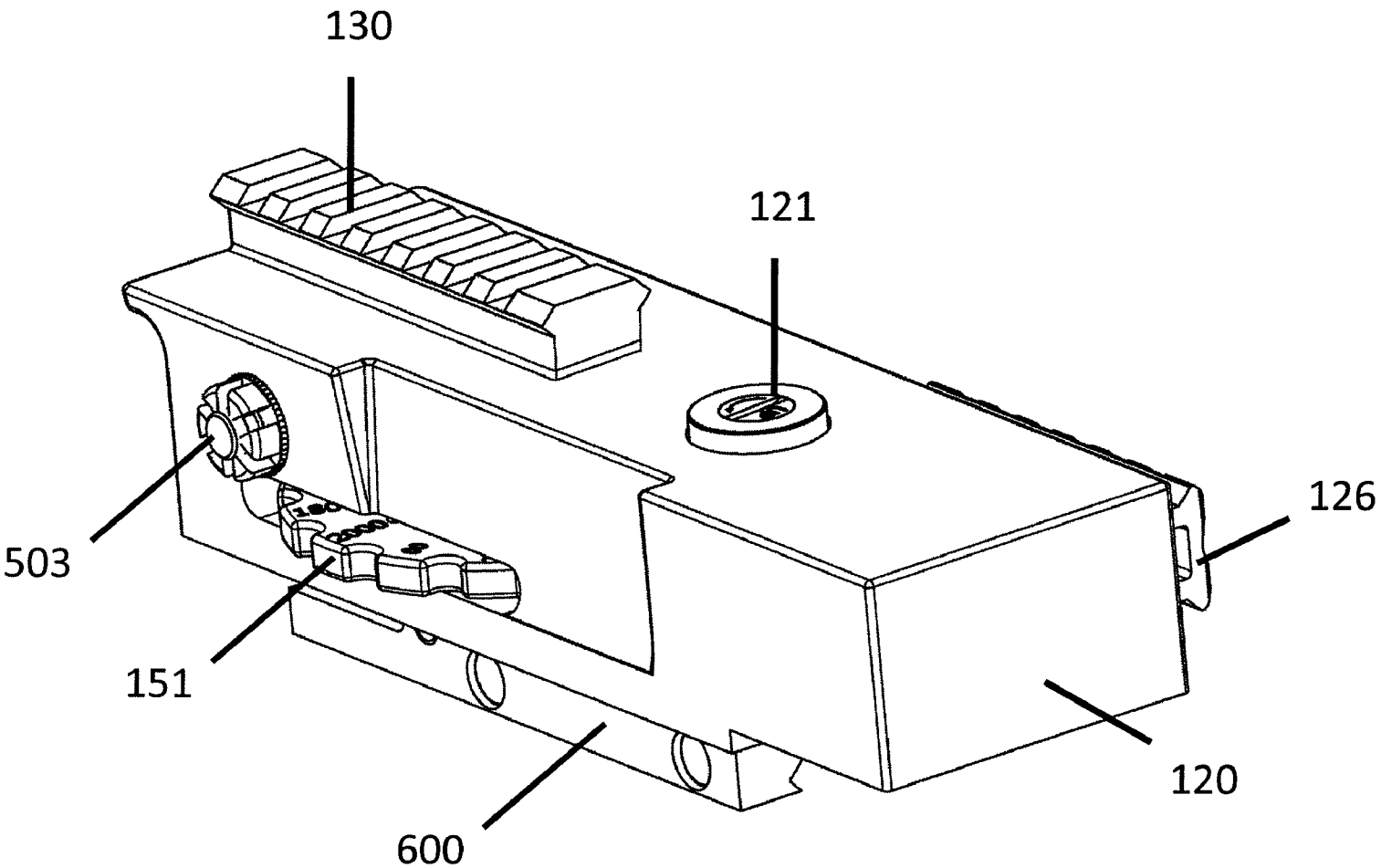
FIG. 2 shows a perspective view of a left back side of the bullet drop compensation mount according to an example embodiment of the invention.
Figure 3:
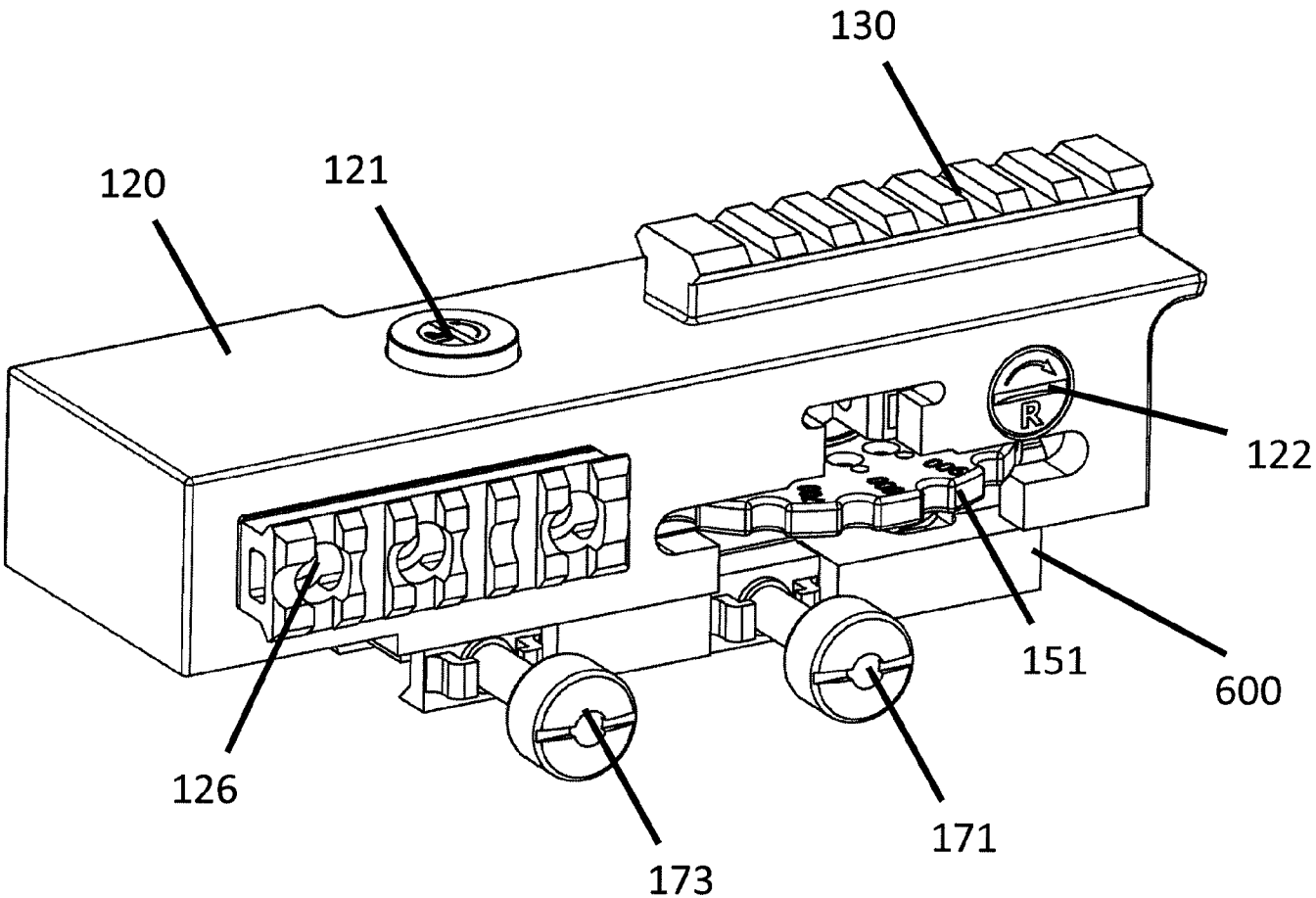
FIG. 3 shows a perspective view of a right back side of the bullet drop compensation mount according to an example embodiment of the invention.
Figure 4:
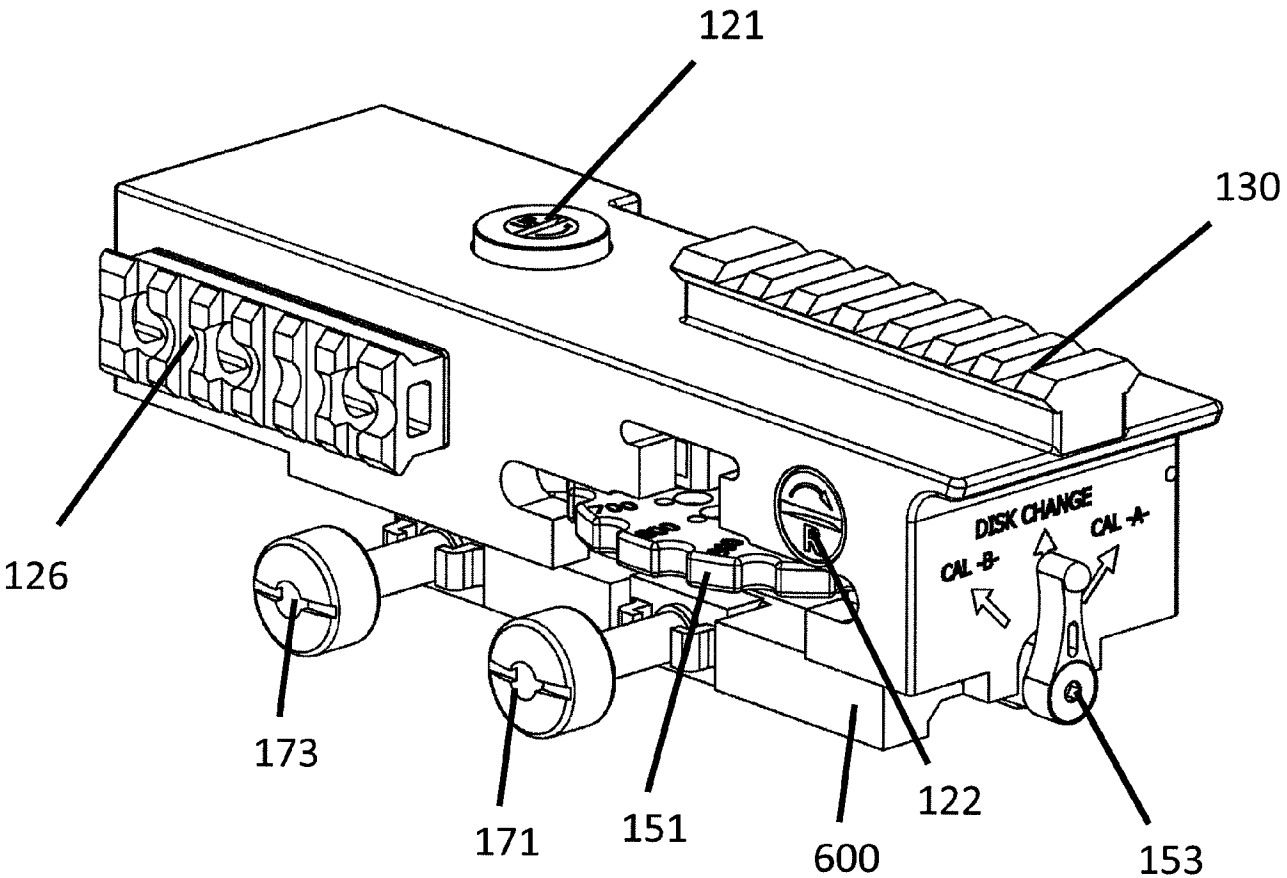
FIG. 4 shows a perspective view of a right front side of the bullet drop compensation mount according to an example embodiment of the invention.
Figure 5:
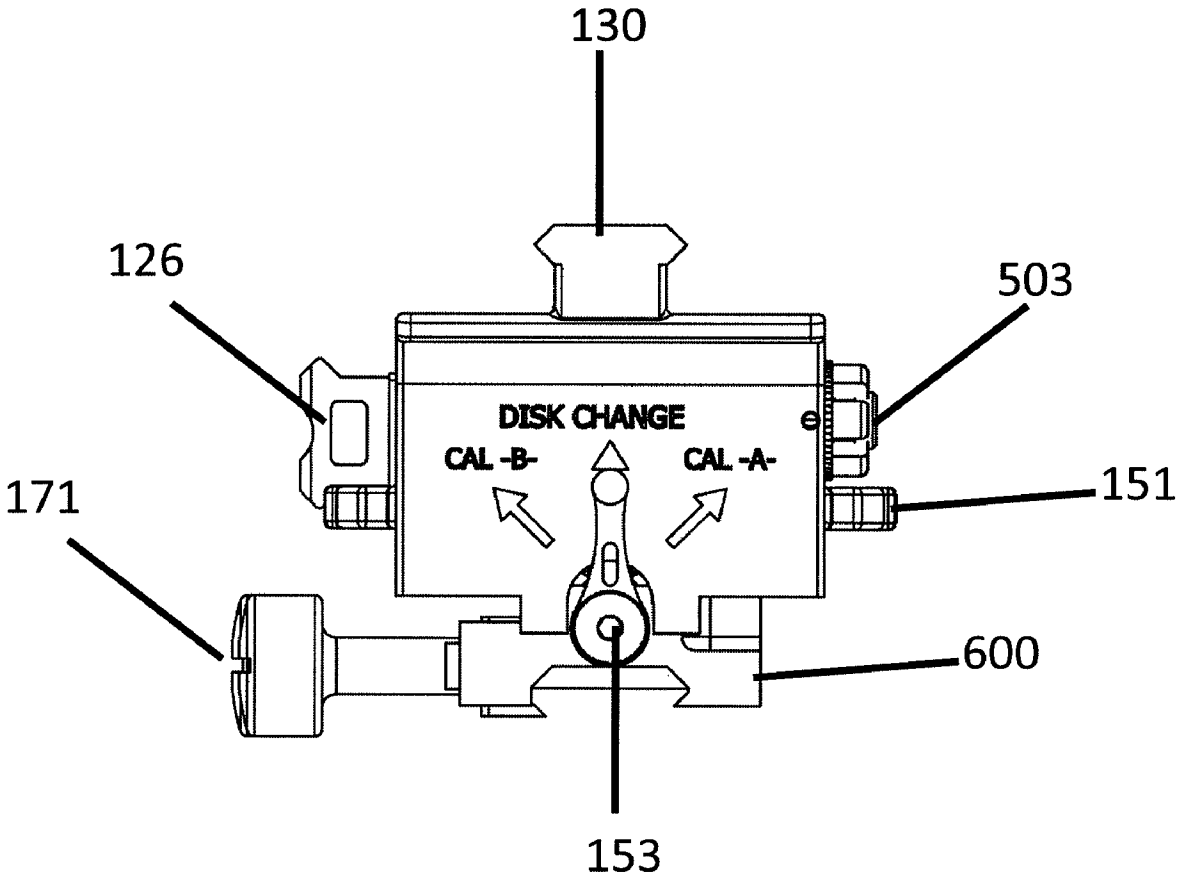
FIG. 5 shows a front elevational view of the bullet drop compensation mount according to an example embodiment of the invention.
Figure 6:
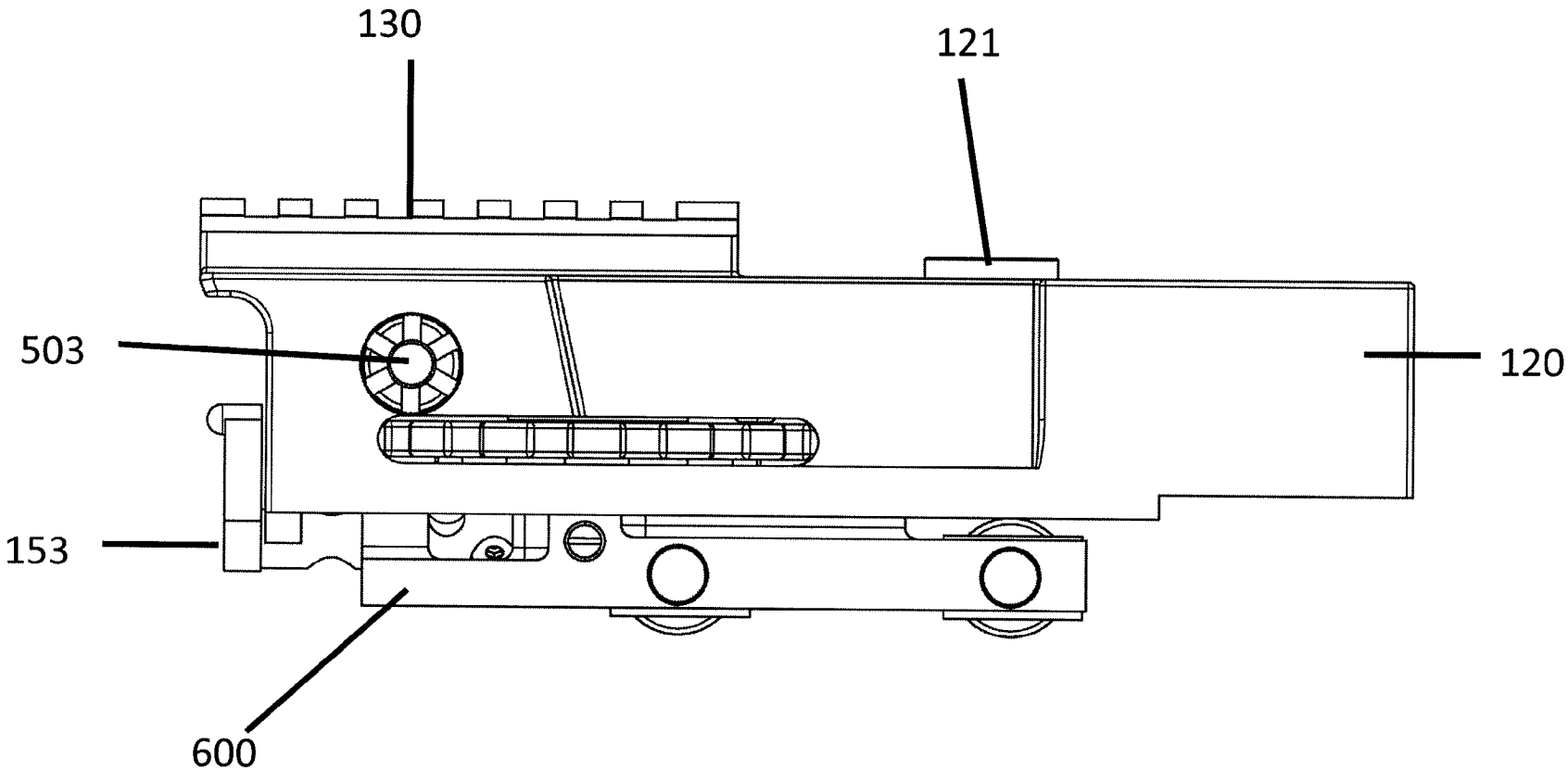
FIG. 6 shows a left side elevational view of the bullet drop compensation mount according to an example embodiment of the invention.
Figure 7:
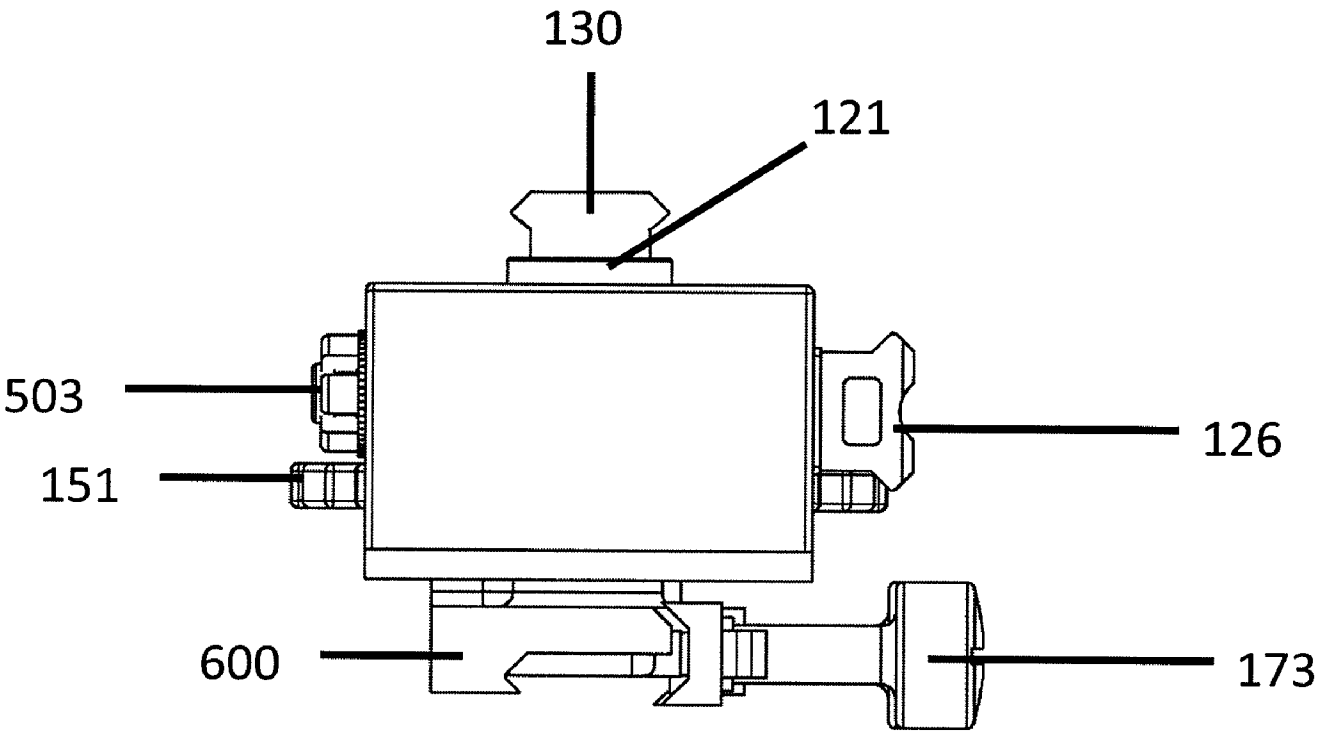
FIG. 7 shows a back elevational view of the bullet drop compensation mount according to an example embodiment of the invention.
Figure 8:
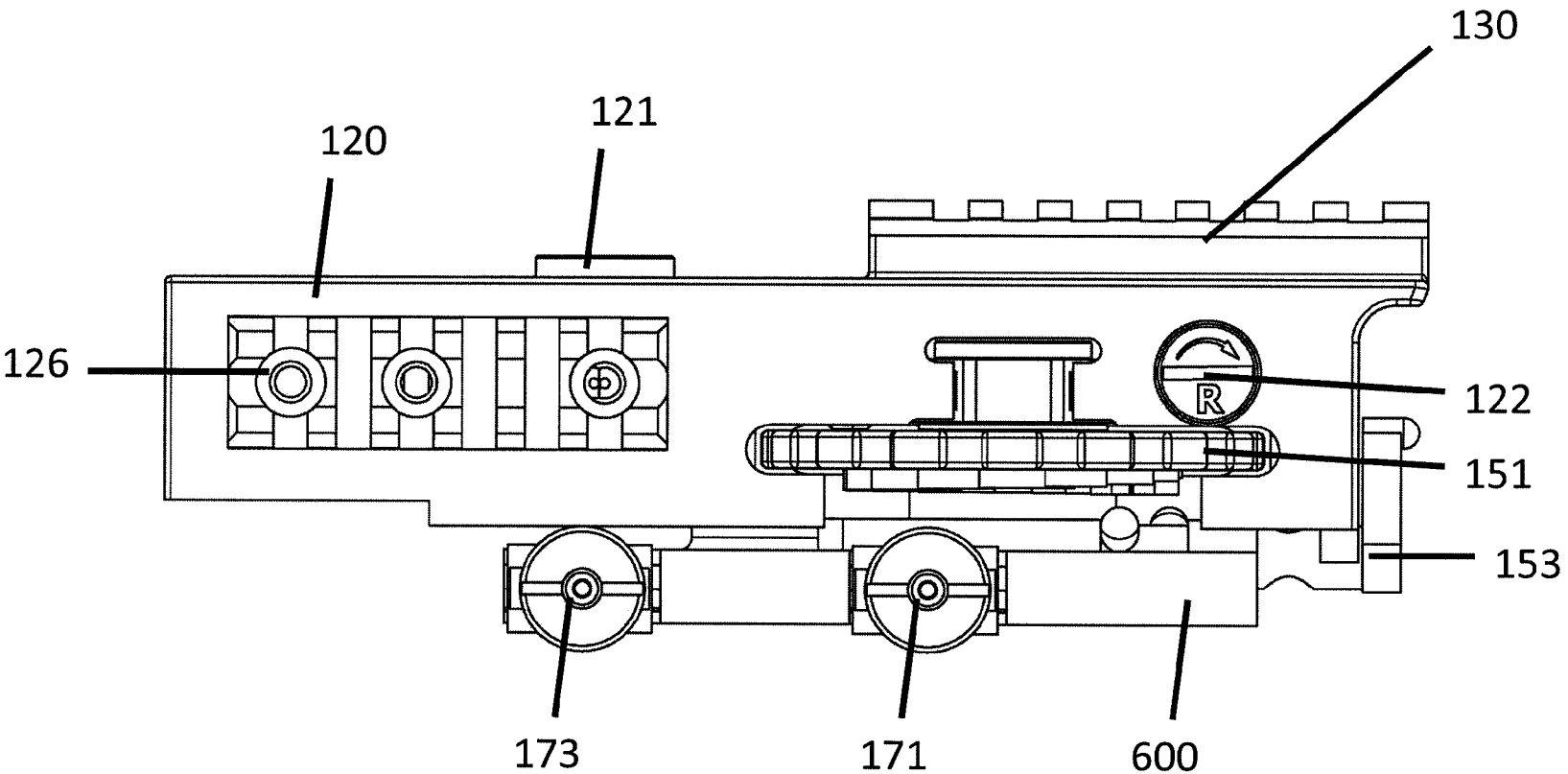
FIG. 8 shows a right side elevational view of the bullet drop compensation mount according to an example embodiment of the invention.
Figure 9:
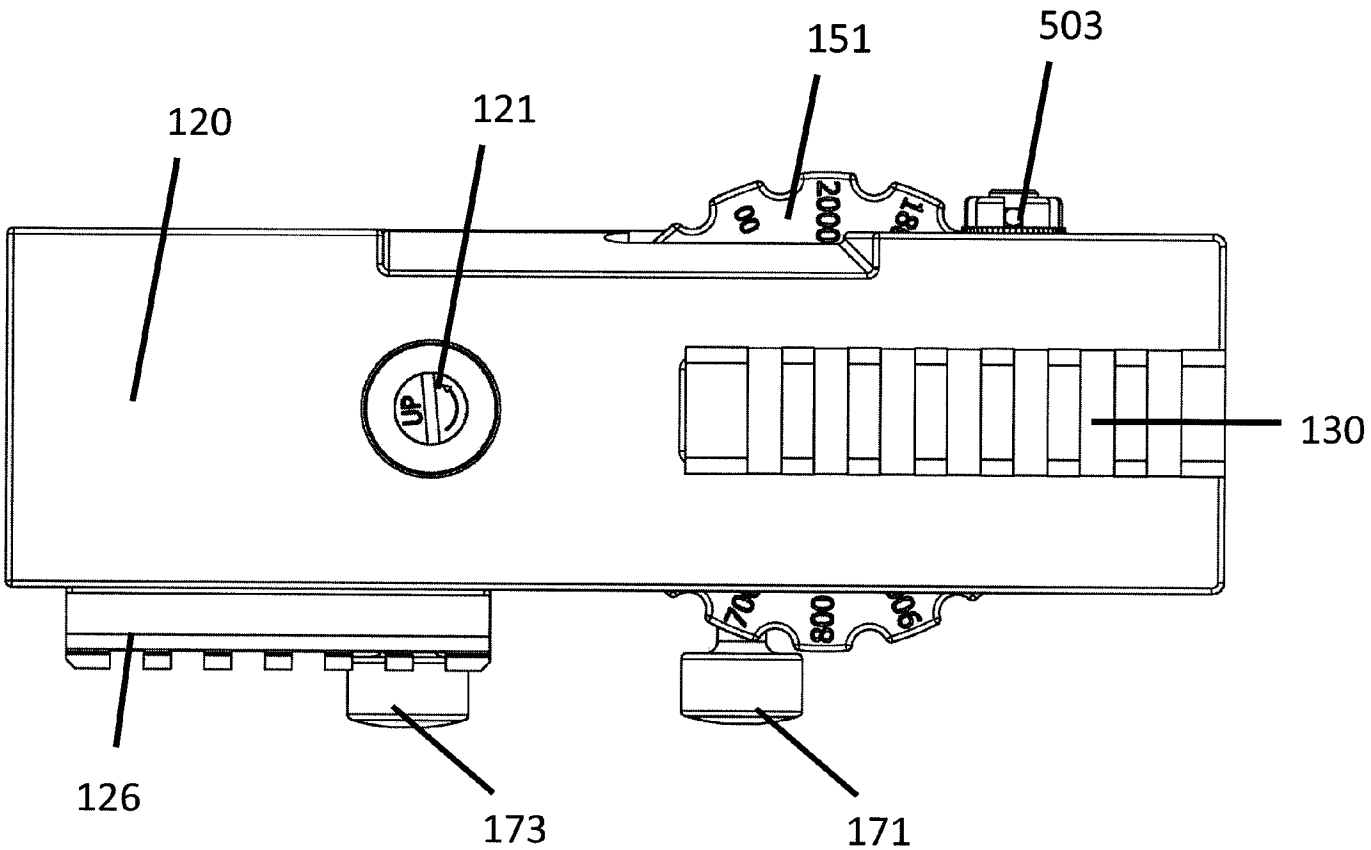
FIG. 9 shows a top plan view of the bullet drop compensation mount according to an example embodiment of the invention.
Figure 10:
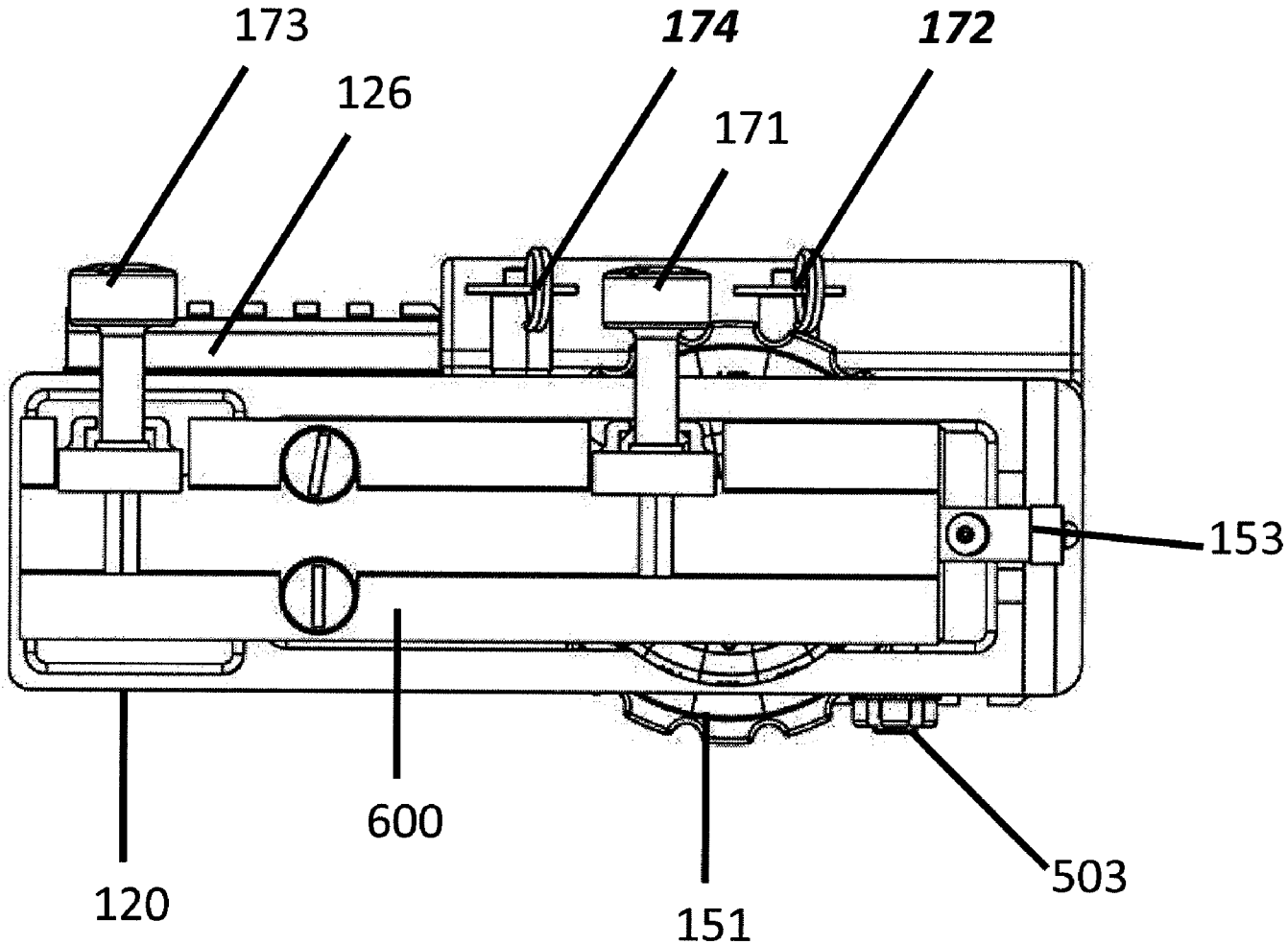
FIG. 10 shows a bottom plan view of the bullet drop compensation mount according to an example embodiment of the invention.

FIGS. 1-10 shows various views of a bullet drop compensation mount according to an example embodiment of the invention, whereby FIG. 1 shows a perspective view of a left front side of a bullet drop compensation mount according to an example embodiment of the invention; FIG. 2 shows a perspective view of a left back side of the bullet drop compensation mount according to an example embodiment of the invention; FIG. 3 shows a perspective view of a right back side of the bullet drop compensation mount according to an example embodiment of the invention; FIG. 4 shows a perspective view of a right front side of the bullet drop compensation mount according to an example embodiment of the invention; FIG. 5 shows a front elevational view of the bullet drop compensation mount according to an example embodiment of the invention; FIG. 6 shows a left side elevational view of the bullet drop compensation mount according to an example embodiment of the invention; FIG. 7 shows a back elevational view of the bullet drop compensation mount according to an example embodiment of the invention; FIG. 8 shows a right side elevational view of the bullet drop compensation mount according to an example embodiment of the invention; FIG. 9 shows a top plan view of the bullet drop compensation mount according to an example embodiment of the invention; and FIG. 10 shows a bottom plan view of the bullet drop compensation mount according to an example embodiment of the invention.

A bullet drop compensation mount 100 includes a body 120, a mounting solution 600 connected to the body 120, an elevation control knob 121 supported by the body 120, an attachment rail 130, a dual bullet drop compensation wheel 151, a caliber adjustment knob 153, and a windage knob stopper/PIN 503. The body 120 also supports a windage knob 122, and an optional side rail 126. In turn, the mounting solution 600 includes a first bolt 171 and a second bolt 173 attached thereto.

As shown in FIGS. 1 and 2, the body 120 is a multiple piece construction that includes various elements. The body 120 supports the dual bullet drop compensation wheel 151 within it in a manner that exposes radial edge portions of the dual bullet drop compensation wheel 151 at opposing side portions of the body 120. Located along a top surface of the body 120 is the attachment rail 130 that is designed to receive a digital module, an optical module, or an all weather machinegun optic (a thermal sight). The attachment rail 130 may receive other modules.

The body 120 supports the elevation control knob 121 at a position that is located behind the attachment rail 130. Accordingly, the elevation control knob 121, and the attachment rail 130 may be collinear. Further, the elevation control knob 121 may be disposed to be flush with the top surface of the body 120.

The body 120 supports the optional side rail 126, which is located on the back right side of the body 120.

As shown in FIGS. 3 and 4, the first bolt 171 and the second bolt 173 serve as knobs to mount the bullet drop compensation mount 100 (including any attached digital 200 or optical module 300) to a firearm by using an attachment device, such as a picatinny rail, that is attached to the firearm. In particular, the mounting solution 600 that is included in the bullet drop compensation mount 100 is directly attached to the firearm or to the attachment device thereof. With the body 120 supporting the mounting solution 600, the first bolt 171 and the second bolt 173 are used in attaching the bullet drop compensation mount 100 to various caliber firearms. The bolts 171 and 173 eliminate the need for wrenches that can be misplaced or lost.

Further, a windage knob 122 is located on a right side of the body 120, above the dual bullet drop compensation wheel 151, and is above the first bolt 171 and the second bolt 173. On an opposite side of the body 120 from the windage knob 122 is the windage knob stopper/PIN 503 that is located above the dual bullet drop compensation wheel 151.

In embodiments of the invention, the dual bullet drop compensation wheel 151 is in a form of a wheel that can be turned clock-wise or counter clock-wise for proper bullet drop compensation over distances. The dual bullet drop compensation wheel 151 is disposed parallel to the body 120, and is generally disposed horizontally along a length of the bullet drop compensation mount 100. In embodiments of the invention, the dual bullet drop compensation wheel 151 is used to adjust for the proper bullet drop compensation over distances.

In embodiments of the invention, use of the calibration adjustment knob 153 enables a user to select a desired caliber setting (e.g., 7.62 mm or 12.7 mm) without using any tools by, for example, being flipped from one side to another. Also, the bullet drop compensation mount 100 may include additional bullet drop compensation wheels to accommodate other dual caliber combinations, such as 5.56 mm/7.62 mm, 12.7 mm/20 mm and others.

In embodiments of the invention, the additional bullet drop compensation wheel 151 can be easily installed into a slot holding the calibration adjustment knob 153 for use with other caliber arms (i.e., 5.56 mm/7.62 mm and 12.7 mm/20 mm caliber arms, for example). By using the calibration adjustment knob 153 that can select between 7.62 mm or 12.7 mm caliber arms, the dual bullet drop compensation wheel 151 may be used to compensate drop of a bullet in 100 m increments –200, 300, 400, 500, 600, 700, 800, 900, 1000, 1100, 1200, 1300, 1400, 1600, 1800 and 2000 in the case of the 7.62 mm caliber arms (with an effective range=800 m, and a Max=1200 m), for example. In the case of the 12.77 mm caliber arms compensation may be used for 200, 300, 400, 500, 600, 700, 800, 900, 1000, 1100, 1200, 1300, 1400, 1600, 1800, and 2000 (with an effective range=1800 m, and a Max=2000 m). For both caliber arms, the bullet drop compensation wheel 151 offers 16 setting (or compensations), but the number is not limited thereto. Any other settings may be used. The dual bullet drop compensation wheel 151 may have notches or protrusions that correspond to each of the increments or settings. The bullet drop compensation wheel 151 may compensate in increments other than 100 m.

In embodiments of the invention, one bullet drop compensation mount 100 may be used for all or a plurality of calibers just by changing a dual bullet drop compensation wheel 151. Accordingly, the bullet drop compensation mount 100 may come with additional dual bullet drop compensation wheels 151 corresponding to a different set of calibers. In embodiments of the invention, each set of calibers may include two calibers. Accordingly, a first dual bullet drop compensation wheel corresponds to one set (a first set) of two calibers, and is exchangeable with another dual bullet drop compensation wheel that corresponds to another set (a second set) of two calibers. The first set of two calibers may be completely different from the second set of two calibers, or one of the two calibers from the first set may be the same as one of the two calibers from the second set.

The bullet drop compensation mount 100 with a dual bullet drop compensation wheel 151 is truly a universal medium and heavy machinegun mount, in which one mount may be used for all calibers just by replacing a dual bullet drop compensation wheel 151.

In FIGS. 1-10, the attachment rail 130 is depicted as a picatinny rail. Nevertheless, in various embodiments of the invention, a means of attaching the digital module 200 or the optical module 300 to the bullet drop compensation mount 100 need not be an attachment rail, such as a picatinny rail. Other devices to effect the attachment thereof may be used.

Figure 11:
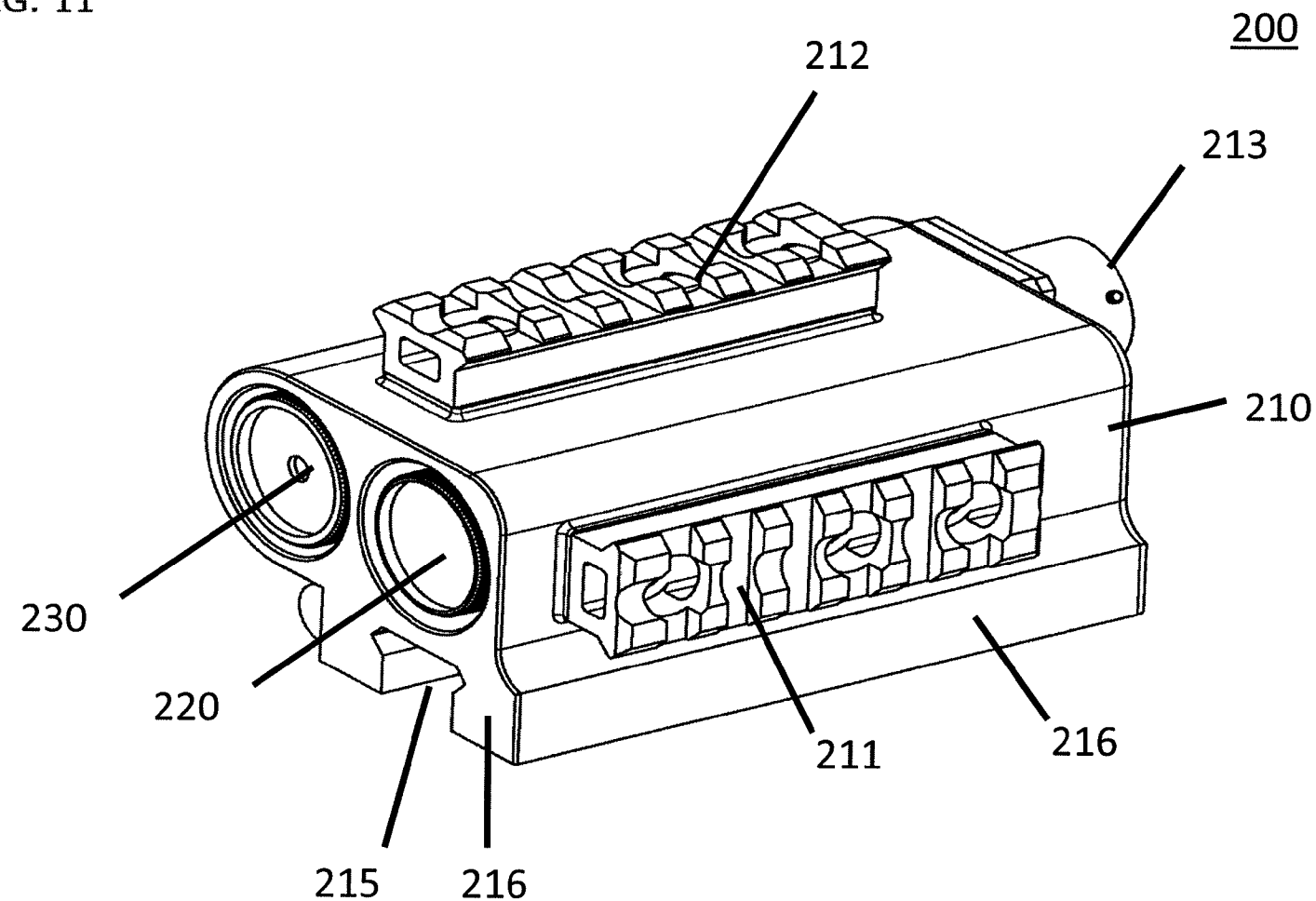
FIG. 11 shows a perspective view of a left front side of a digital module according to an example embodiment of the invention.
Figure 12:
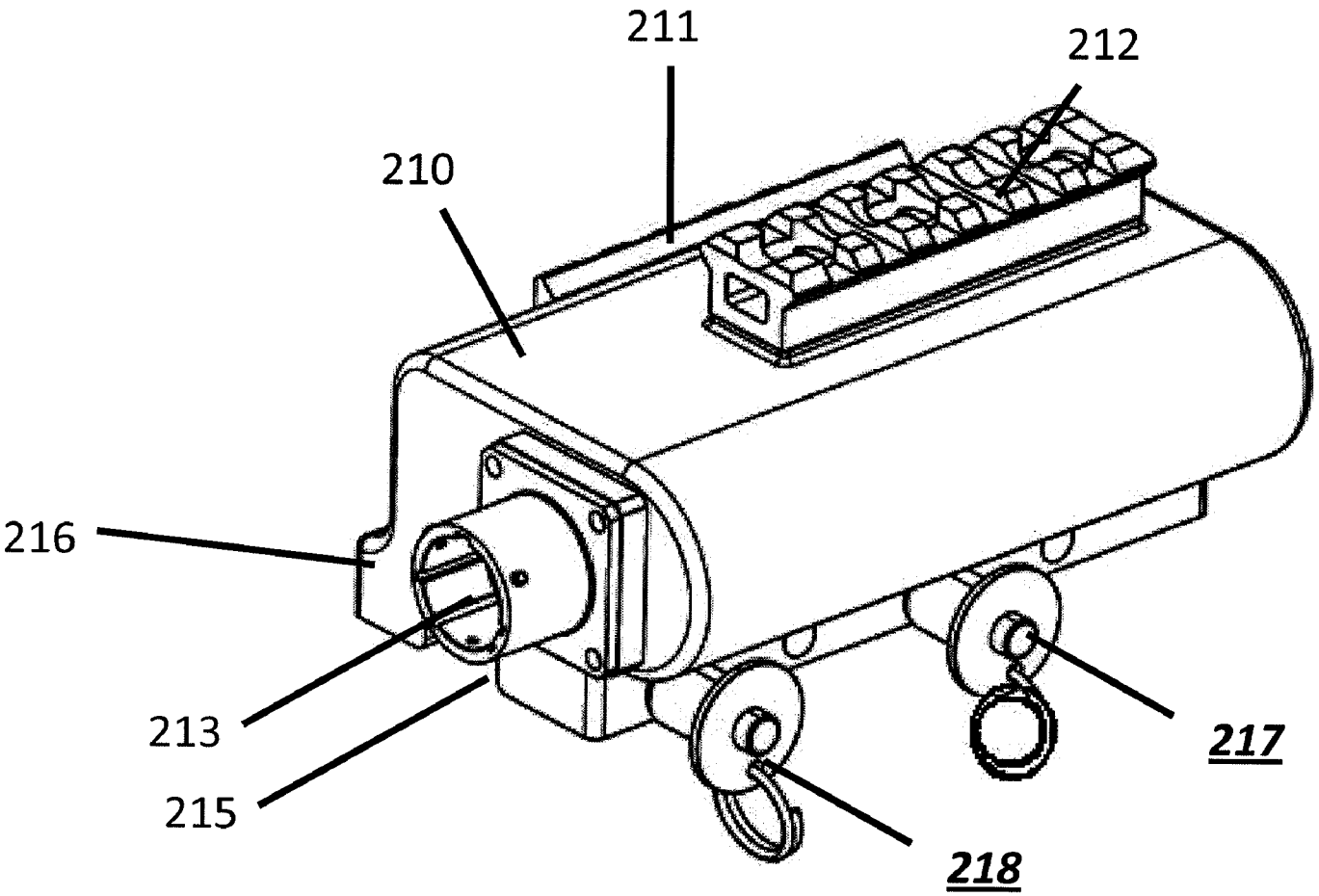
FIG. 12 shows a perspective view of a right back side of the digital module according to an example embodiment of the invention.
Figure 13:
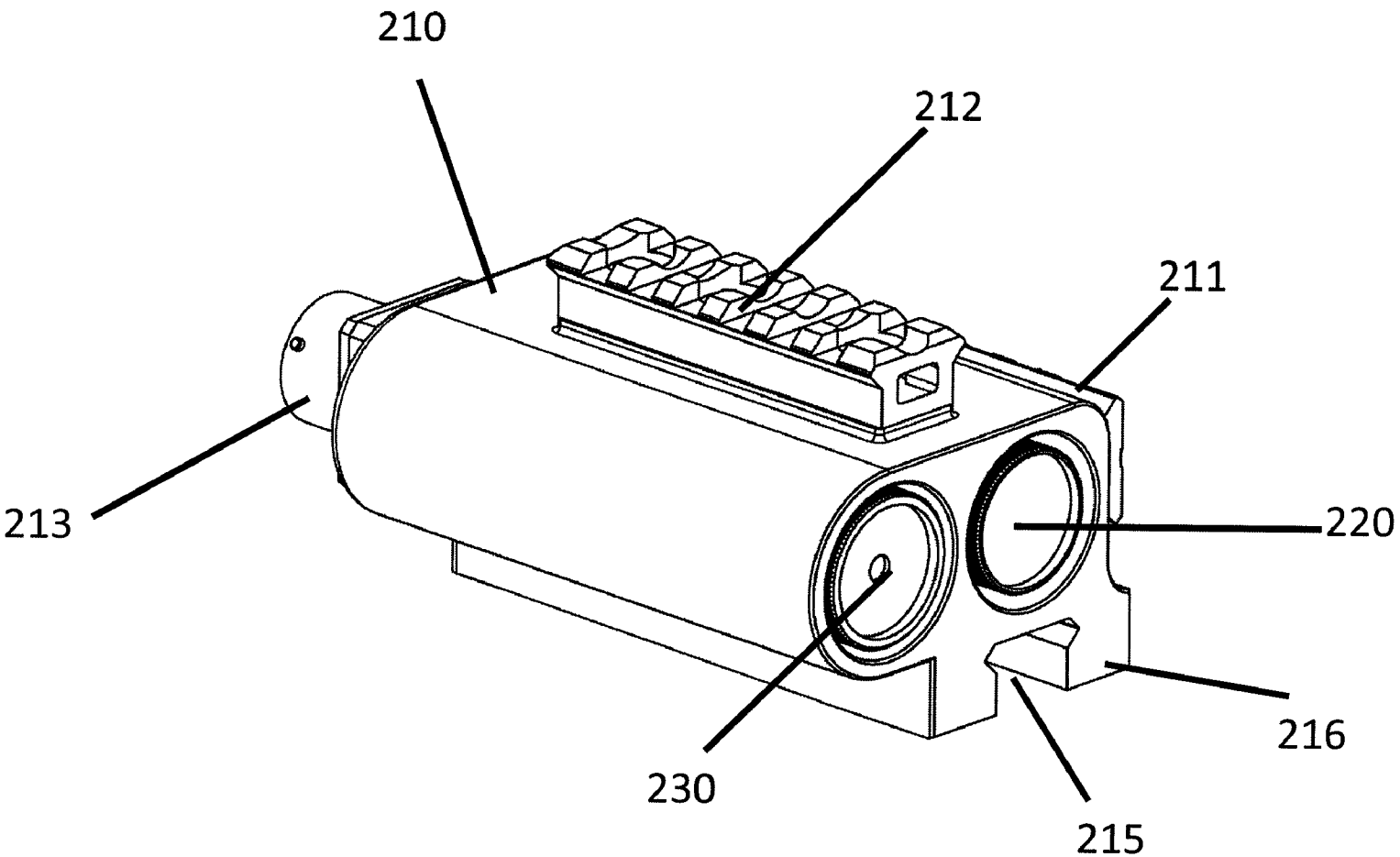
FIG. 13 shows a perspective view of a right front side of the digital module according to an example embodiment of the invention.

Hereinafter, a digital module 200 will be discussed. FIGS. 11-13 show various views of a digital module according to an example embodiment of the invention, whereby FIG. 11 shows a perspective view of a left front side of a digital module according to an example embodiment of the invention; FIG. 12 shows a perspective view of a right back side of the digital module according to an example embodiment of the invention; and FIG. 13 shows a perspective view of a right front side of the digital module according to an example embodiment of the invention.

The digital module 200 according to an example embodiment of the invention includes a body 210 supporting one or more rails 211 and 212, a mil-connector 213, a platform 216 containing a receiving groove 215, a camera 220, and an illuminator 230 emitting an infrared (IR) or laser light.

In greater detail, the body 210 supports a side rail 211 and a top rail 212, but the number of rails 211 and 212 may vary, such as the number of attachments to be provided to the digital module 200. In embodiments of the invention, an additional optional side rail may be included at an opposite side of the body 210 from the side rail 211. In embodiments of the invention, the side rail 211 may support a dazzler laser, which may emit a non-lethal laser at an enemy to temporarily blind the enemy, for example. The camera 220 is will have a capability to detect an enemy pointing with a laser.

The mil-connector 213 is attached to a cable that provides power from a power pack to the camera 220 and the illuminator 230, and also carries data signals from the camera 220 to an external display device and carries control signals from an external controller to the camera 220 and the illuminator 230.

The platform 216 is formed integrally with the body 210, and thereby supports the digital module 200. The receiving groove 215 is formed so as to fit onto the attachment rail 130 of the bullet drop compensation mount 100 to secure placement of the digital module 200 onto the bullet drop compensation mount 100. Two easily attachable/removable pins 217 and 218 are used to secure the digital module 200 into the bullet drop compensation mount 100, but the number thereof need not be limited to two.

The camera 220 is a device that obtains image data from an object by converting light from the object into the image data by using an image capturing sensor, such as a charge-coupled device (CCD) and an active pixel sensor. The obtained image data may be processed in the camera 220, or may be transmitted to the external controller and/or the external display device via the cable attached to the mil-connector 213. The camera 220 may have a zoom function, which may be performed by a zoom lens system included in the camera 220 (i.e., optical zoom) or by processing the image data (i.e., digital zoom), or a combination thereof. In embodiments of the invention, various magnifications of optical zooms and digital zooms are usable, such as up to 10× optical zoom, and/or up to 4× digital zoom. Use of the zoom function permits users to positively identity enemy targets at a long distance.

In addition to providing image data, the camera 220 may provide a reticle used for targeting, which may be overlaid on the image data. The reticle may be a circle reticle having a dot and an enclosing circle, a mil-dot reticle having measurements or markings in an x and/or a y axis direction, or a target dot reticle with a single dot. Other reticles may be used. In embodiments of the invention, the circle reticle may be used for ground operations by, for example, infantry; the mil-dot reticle may be used for sea operations by, for example, on seacrafts; and the target dot reticle may be used for air operations by, for example, on aircrafts. In embodiments of the invention, the reticle need not be provided by the camera 220, and instead, may be provided by the external display device or the external controller.

The illuminator 230 emits at least one of an infrared (IR) light or a laser light so that, for example, a target is illuminated during a night operation or under darkness. The illuminator 230 acts as a flashlight to shine light on the target so that the target becomes visible to a naked eye or via the video image from the camera 220. For example, when an IR light is emitted from the illuminator 230, the camera 220 is able to obtain an image of the object being shined by the IR light.

In the digital module 200 shown in FIGS. 11-13, the camera 220 and the illuminator 230 are arranged side by side in a horizontal direction. Nevertheless, in other embodiments of the invention, the camera 220 and the illuminator 230 may be arranged vertically, so that the camera 220 is stacked on top of the illuminator 230, or vice-versa. In other arrangements according to an embodiment of the invention, the camera 220 and the illuminator 230 may be arranged diagonally from each other. For accurate shooting, the camera 220 must be installed on top of the attachment rail 130. In addition, the camera 220 has capability to detect enemy lasers pointing at users of the DMO providing an early warning to take cover prior to a possible fire power. An IR warning sign will be displayed on a head mounted display (HMD) to save lives.

The digital module 200 may be aligned to the bullet drop compensation mount 100, so that they may be attached to each other by way of the receiving groove 215 of the digital module 200 being fitted onto the attachment rail 130 of the bullet drop compensation mount 100 by sliding onto the attachment rail 130. Using the front pin 217 and the back pin 218, the digital module 200 is secured to the bullet drop compensation mount 100.

Various devices may be used with the digital module 200 by attachment through the at least one of the rails 211-213 (where the rail 213 is an optional rail), such as a small dot sight, which may be used as an aiming device in case of the digital module failure. In embodiments of the invention, each of the rails 211-213 may be a picatinny rail. Other devices include laser pointers, illuminators (or flashlights), laser range finders, night vision devices, thermal cameras or others.

Figure 14:
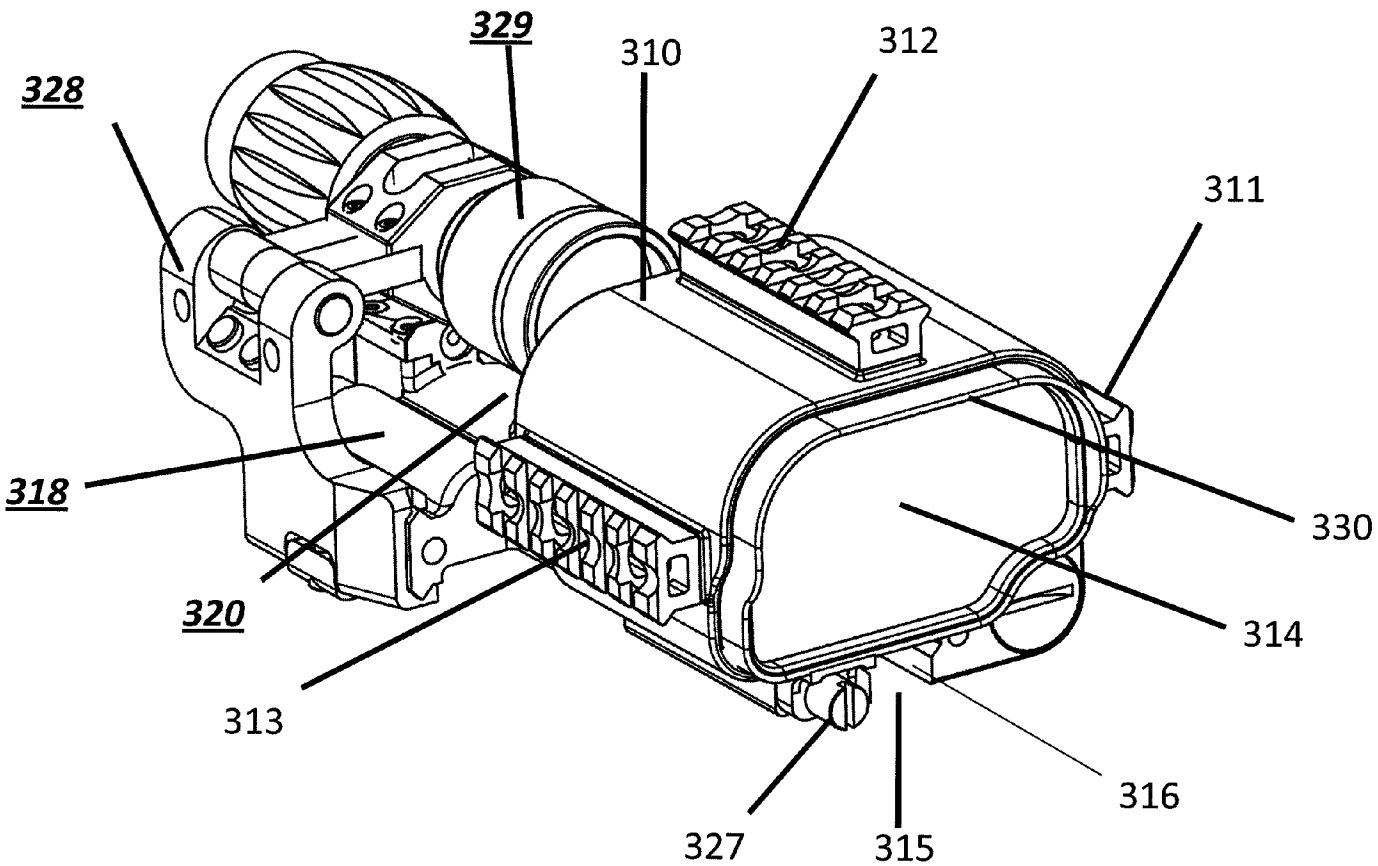
FIG. 14 shows a perspective view of a right front side of an optical module according to an example embodiment of the invention.
Figure 15:
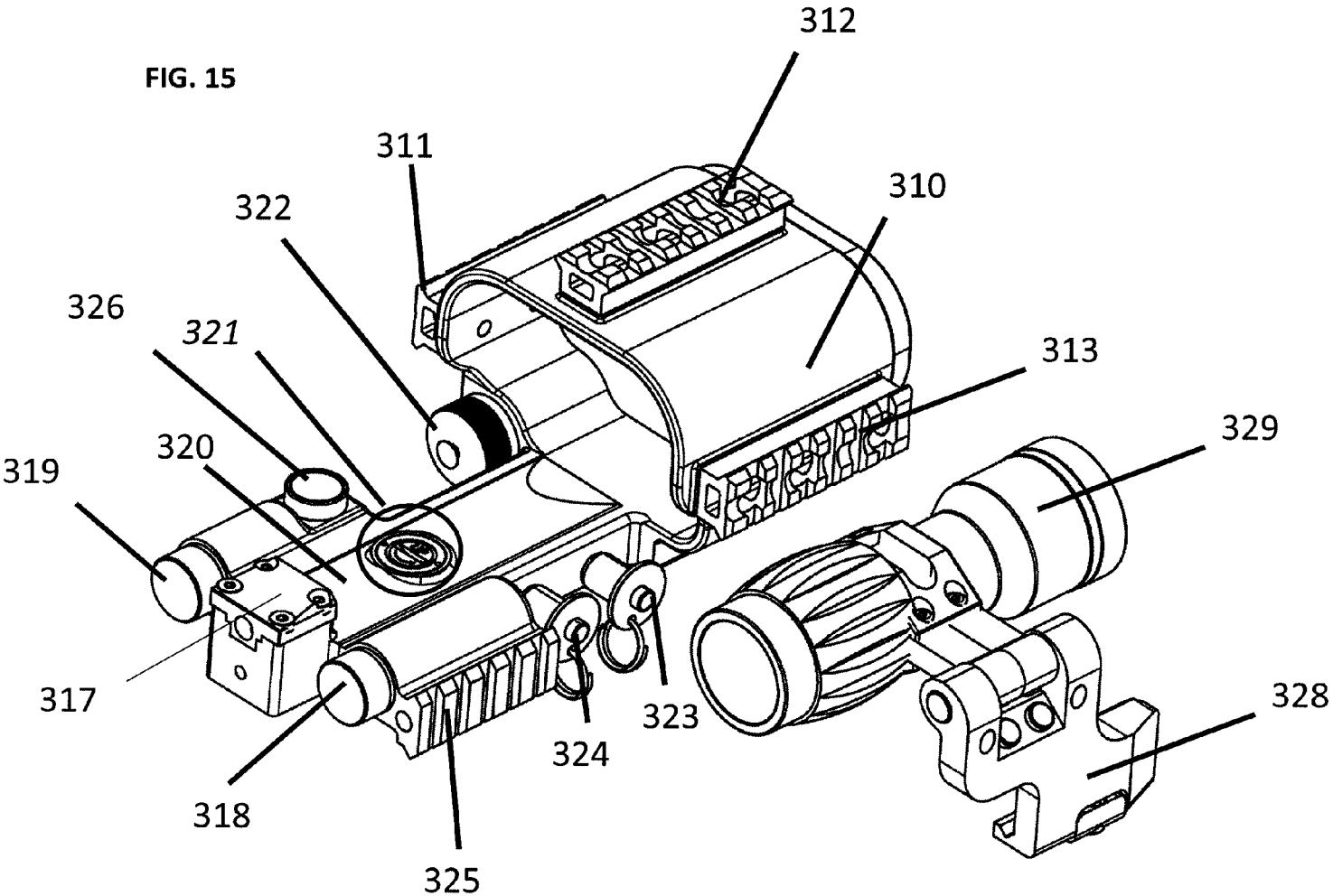
FIG. 15 shows a perspective view of a right back side of the optical module according to an example embodiment of the invention.

Hereinafter, an optical module 300 will be discussed. FIGS. 14 and 15 show various views of an optical module according to an example embodiment of the invention, whereby FIG. 14 shows a perspective view of a right front side of an optical module according to an example embodiment of the invention; and FIG. 15 shows a perspective view of a right back side of the optical module according to an example embodiment of the invention.

An optical module 300 according to an example embodiment of the invention includes a window frame 310 supporting a transparent lens 314 and one or more rails 311-313, and a platform 316 containing a receiving groove 315. In greater detail, the window frame 310 supports a top rail 312 and two side rails 311 and 313, but the number of the rails 311-313 may vary depending on various factors, such as a size of the window frame 310 and number of attachments to be provided to the optical module 300.

FIG. 14 shows a shape of the transparent lens 314 as a rounded rectangular shape, but other examples of the shapes of the transparent lens 314 may include a rectangular shape, windshield shape, trapezoid shape, lens shape, oval shape, and octagonal shape, and may also include additional room on each side to display target information. For example, data such as the distance from a laser range finder, IR detector, wind, elevation, and other necessary data to enhance a shooter's precision can be displayed on the transparent lens 314, such as on the sides (e.g., left or right), as target information. In embodiments of the invention, the target information may be displayed anywhere on the transparent lens 314. As shown in FIG. 14, and in greater detail, a protective window 330 is placed within an encompassment of the window frame 310 to prevent or reduce foreign objects such as water, dust, etc., from reaching the transparent lens 314. The protective window 330 is installed by tightening a PW locking knob 327 in one direction, and is removed by turning the PW locking knob 327 in an opposite direction. The protective window 330 proportionally resembles a shape of the window frame 310.

Further, when a light, such as a light of red color (or any other color), is made incident on the transparent lens 314, a dot or a shape (or a pattern) is displayed on an incident surface of the transparent lens 314 so that a shooter simply needs to align the dot or the shape over a target for accurate targeting or sighting. The window frame 310 may host a protective window, filter or honeycomb to protect the transparent lens 314 and to protect users from enemy snipers. A filter or a honeycomb will reduce reflections from the transparent lens 314 and also reduce brightness of the dot or shape to thereby reduce a risk of detection.

In embodiments of the invention, the dot or shape that is displayed on the incident surface of the transparent lens 314 may be a reticle in a similar manner as discussed above for the digital module 200.

Various devices may be used with the optical module 300 by attachment through the at least one of the rails 311-313, such as a dazzler laser, which may be used as a self protection device. In embodiments of the invention, each of the rails 311-313 may be a picatinny rail. Other devices include laser pointers, illuminators (flashlights), laser range finders, night vision devices, thermal cameras or others.

The platform 316 is formed integrally with the window frame 310, and thereby supports the optical module 300. The receiving groove 315 is formed so as to fit onto the attachment rail 130 of the bullet drop compensation mount 100 to secure placement of the optical module 300 onto the bullet drop compensation module 100. Two pins 323 and 324 are used to secure or lock the optical module 300 into the bullet drop compensation mount 100, but the number thereof need not be limited to two.

The optical module 300 according to an example embodiment of the invention also includes electronic components such as a battery case 322, two switches 318 and 319, a light emitting diode (LED) module 317, an elevation control knob cap 321 that is connected to the elevation knob 121 for an easy access to the elevation knob 121 located on the bullet drop compensation mount 100, and an optical body 320. The optical body 320 is an open design to prevent accumulation of foreign objects such as rain or snow or dirt that might interfere with the LED module 317 from projecting a reticle to the transparent lens 314. Additionally, as shown in FIGS. 14 and 15, and in greater detail, a 3× magnification 329 is installed on a flip type mount 328, which is attached to a rear rail 325. FIG. 15 shows an optical module with the 3× magnification 329 and the flip type mount 328 detached from the rear rail 325. Also shown in FIG. 15 are an auto-brightness detector 326, a battery compartment 322, and the elevation control knob cap 321.

Figure 16:
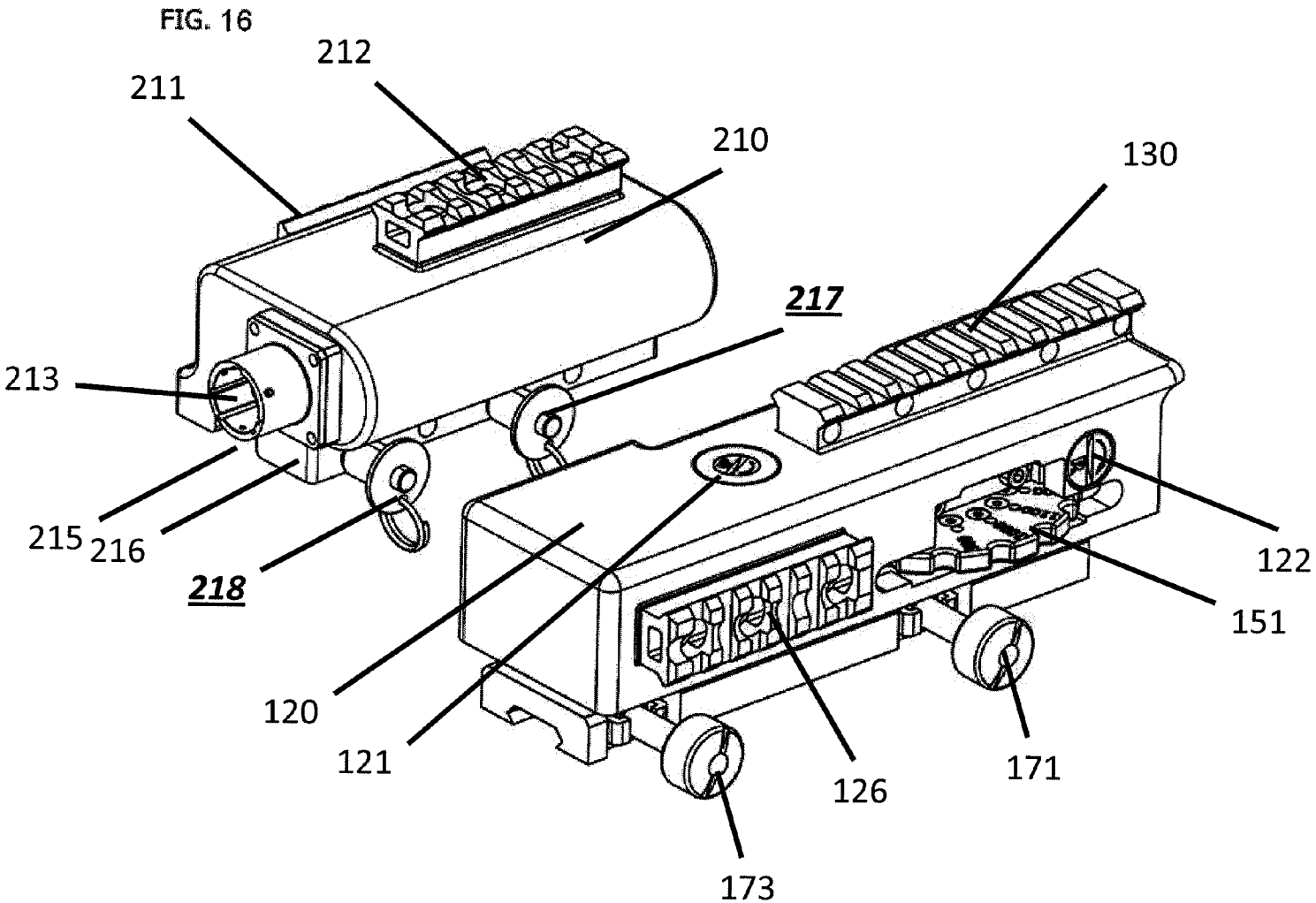
FIG. 16 shows a perspective view of a right back side of the bullet drop compensation mount and the digital module prior to attachment according to an example embodiment of the invention.
Figure 17:
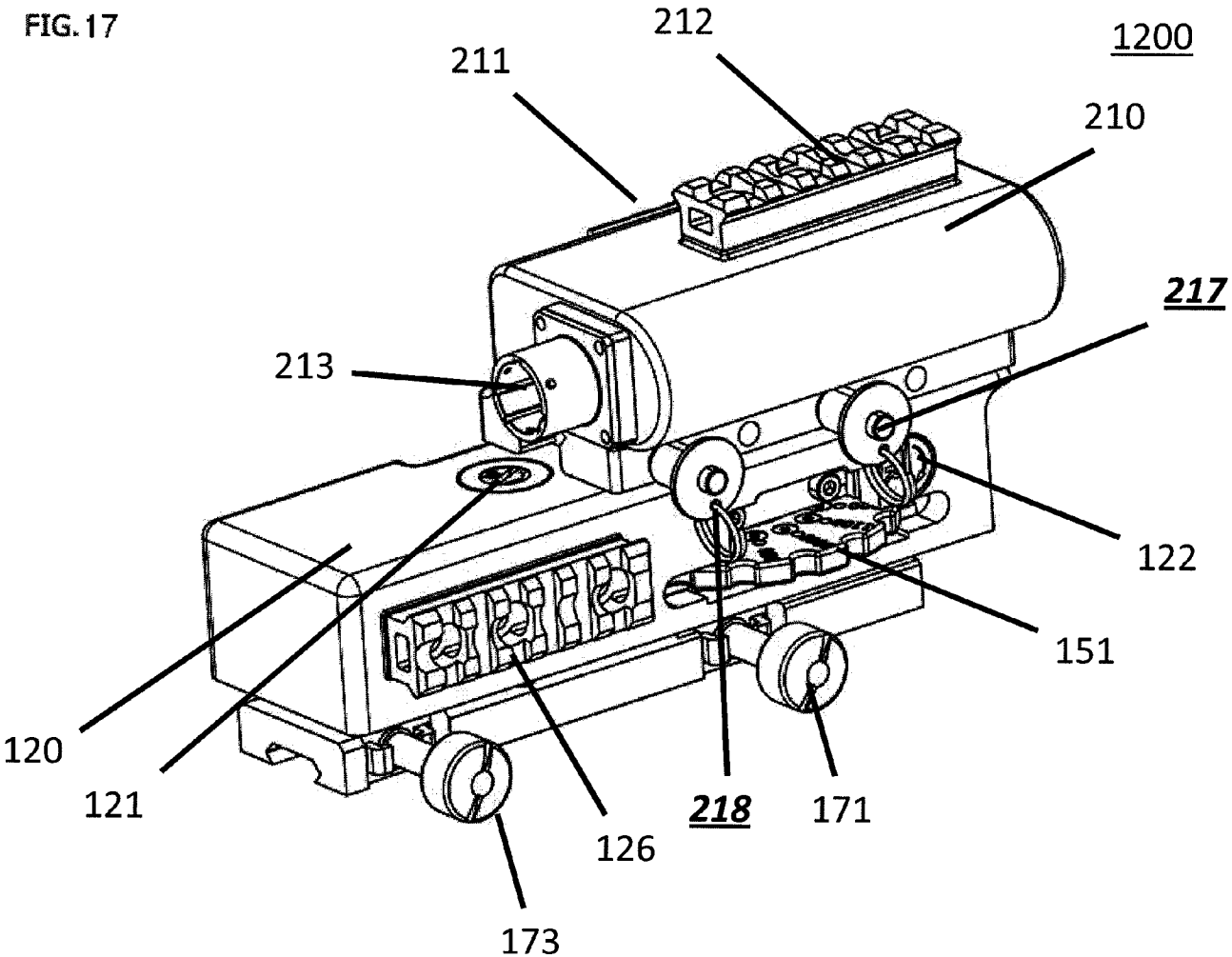
FIG. 17 shows a perspective view of a right back side of the bullet drop compensation mount and the digital module after attachment according to an example embodiment of the invention.

Hereinafter, a digital machinegun optic (DMO), which is a modularly combined bullet drop compensation mount 100 and digital module 200, will be discussed. FIG. 16 shows a perspective view of a right back side of the bullet drop compensation mount and the digital module prior to attachment according to an example embodiment of the invention. FIG. 17 shows a perspective view of a right back side of the bullet drop compensation mount and the digital module after attachment according to an example embodiment of the invention. When combined, the bullet drop compensation module 100 and the digital module 200 forms the digital machinegun optic (DMO) 1200.

As shown in FIG. 16, the digital module 200 may be aligned to the bullet drop compensation mount 100, so that they may be attached to each other by way of the receiving groove 215 of the digital module 200 being fitted onto the attachment rail 130 of the bullet drop compensation mount 100 by sliding onto the attachment rail 130. FIG. 17 shows the completed attachment of the platform 216 to the attachment groove 130. By using the two pins 217 and 218, the digital module 200 is properly attached and secured to the bullet drop compensation mount 100.

It is particularly noted that the placement of the camera 220 in the digital machinegun optic 1200 is such that a center of the camera 220 is aligned vertically with a vertical line that is defined by a center of the adjustment knob 153 and a center of the attachment rail 130. Accordingly, the center of the adjustment knob 153, the center of the attachment rail 130 and the center of the camera 220 are aligned vertically.

Figure 18:
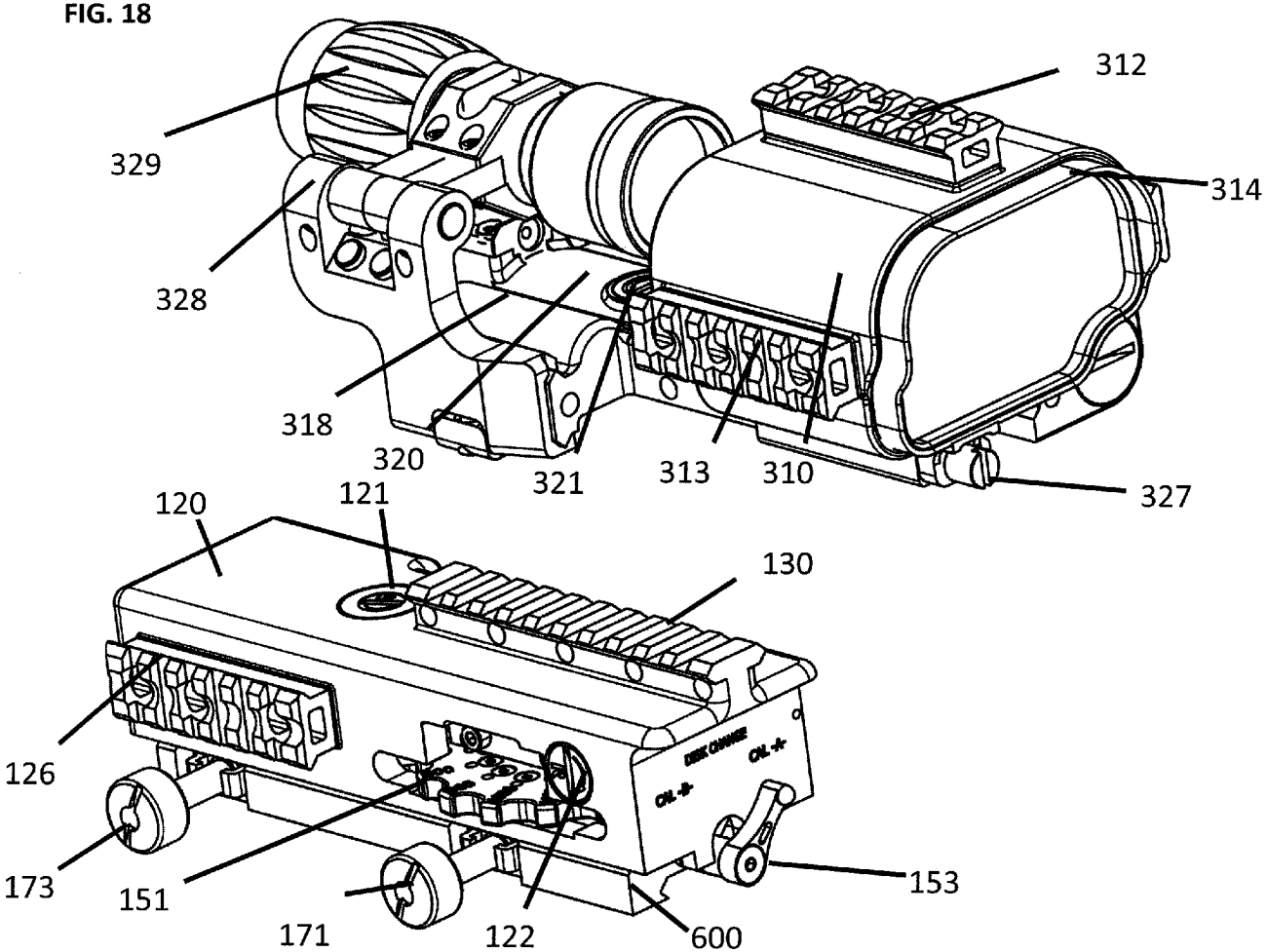
FIG. 18 shows a perspective view of a right front side of the bullet drop compensation mount and the optical module prior to attachment according to an example embodiment of the invention.
Figure 19:
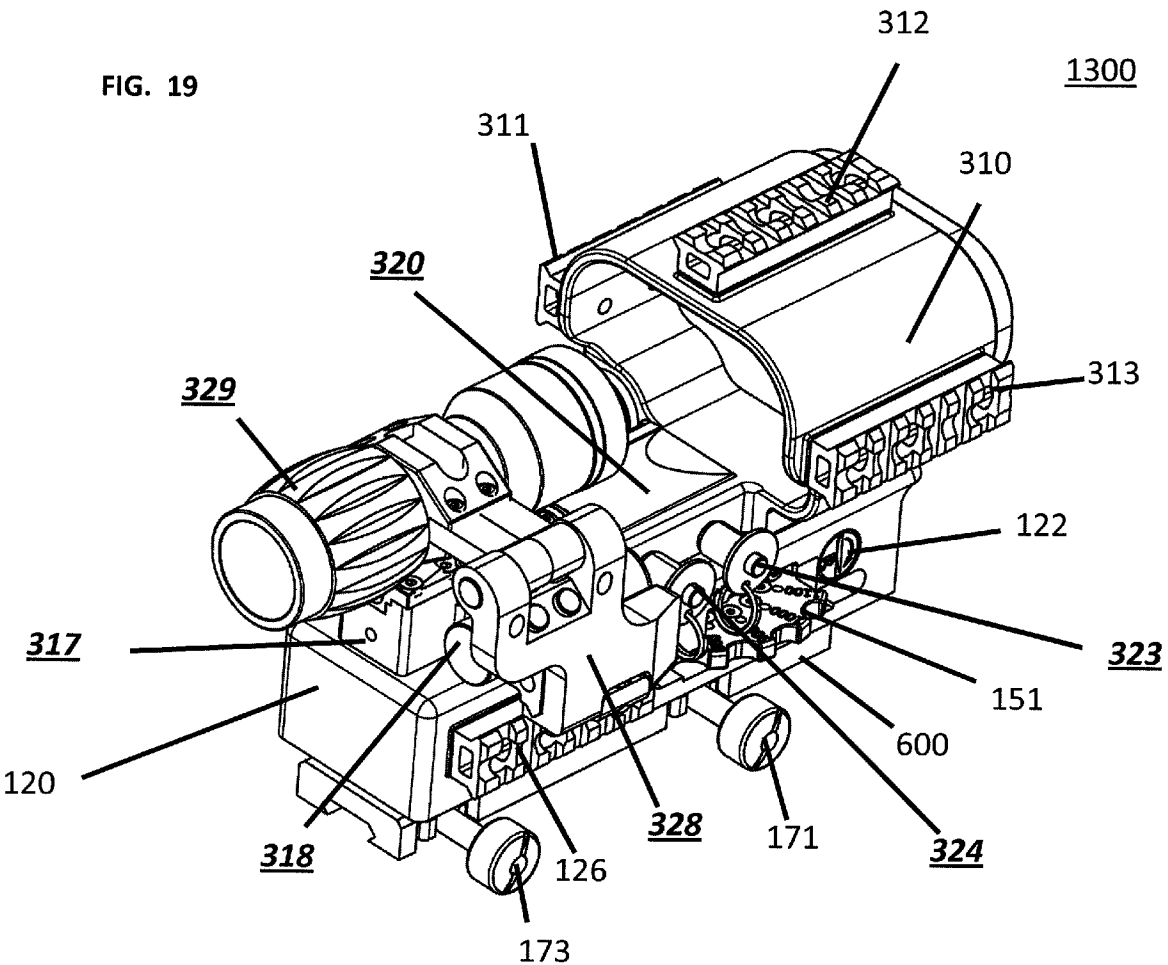
FIG. 19 shows a perspective view of a right back side of the bullet drop compensation mount and the optical module after attachment according to an example embodiment of the invention.

Hereinafter, a universal machinegun optic (UMO), which is a modularly combined bullet drop compensation mount 100 and optical module 300, will be discussed. FIG. 18 shows a perspective view of a right front side of the bullet drop compensation mount and the optical module prior to attachment according to an example embodiment of the invention. FIG. 19 shows a perspective view of a right back side of the bullet drop compensation mount and the optical module after attachment according to an example embodiment of the invention. When combined, the bullet drop compensation module 100 and the optical module 300 forms the universal machinegun optic (UMO) 1300.

As shown in FIG. 18, the optical module 300 may be aligned to the bullet drop compensation mount 100, so that they may be attached to each other by way of the receiving groove 315 of the optical module 300 being fitted onto the attachment rail 130 of the bullet drop compensation mount 100 by sliding onto the attachment rail 130. FIG. 19 shows the completed attachment of the platform 316 to the attachment groove 130.

It is particular noted that the placement of the transparent lens 314 in the universal machinegun optic (UMO) 1300 is such that a center of the transparent lens 314 is aligned vertically with a vertical line that is defined by a center of the adjustment knob 153 and a center of the attachment rail 130. Accordingly, the center of the adjustment knob 153, the center of the attachment rail 130 and the center of the transparent lens 314 are aligned vertically.

Figure 20:
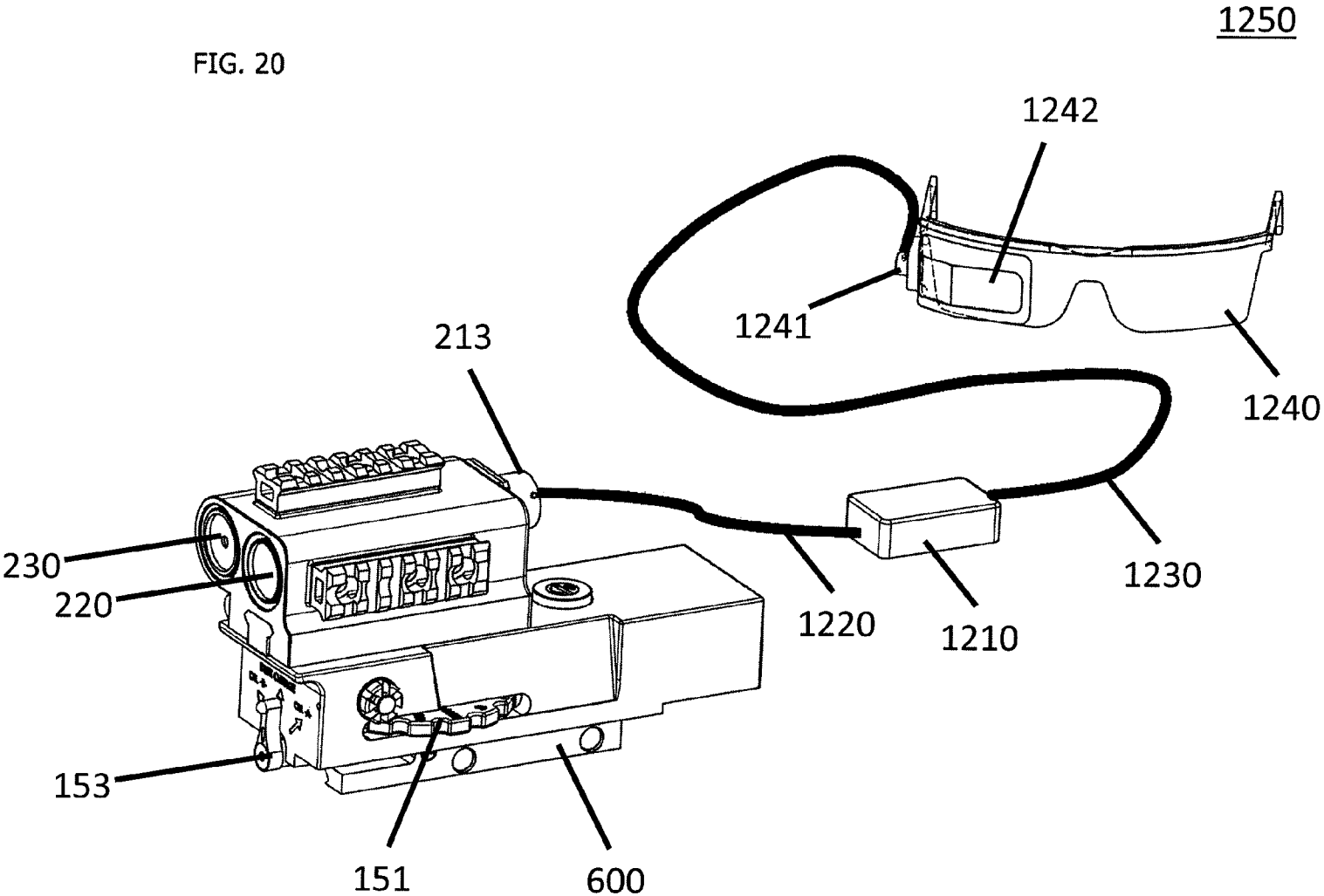
FIG. 20 shows a digital machinegun optic (DMO) attached to a control box and a head mounted display according to an example embodiment of the invention.

Hereinafter, a digital machinegun optic (DMO) used with a head mounted display (HMD) will be discussed. FIG. 20 shows a digital machinegun optic attached to a head mounted display (HMD) according to an example embodiment of the invention.

FIG. 20 shows a complete/integrated solution 1250 that includes the digital machinegun optic (DMO) 1200, a cable (shown as two portions 1220 and 1230), a power pack/control box module (or an external controller) 1210, and a head mounted display module 1240 having a connection portion 1241 and a display portion (or an external display device) 1242. Hereinafter, the display portion 1242 is referred to as a head mounted display (HMD) 1242. In operation, an obtained image data is transmitted to the external controller 1210 and to the head mounted display (HMD) 1242 via the cable 1220 and 1230 attached to the mil-connector 213 to enable a shooter to accurately take aim at a target using the above discussed reticles that are displayed on the head mounted display (HMD) 1242 so that a shooter simply needs to ensure that the reticle aligned over the target for accurate targeting or sighting. That is, to align the reticle over the target, the bullet drop compensation mount 100 of the digital machinegun optic (DMO) 1200 is manipulated to control for a proper bullet drop compensation. Accurate distance information can be obtained by using a laser range finder, for example, and information about a target may be displayed on the head mounted display (HMD) 1242. The head mounted display (HMD) 1242 is detachable from a goggle configuration. Accordingly, the head mounted display (HMD) 1242 may be attached to any surface, such as a helmet or even a transparent shield. The head mounted display (HMD) 1242 may be a display screen that is attached to (or formed in) the digital module 200 or the digital machinegun optic (DMO) 1200 in other embodiments of the invention.

In embodiments of the invention, the control box module 1210 allows users to turn on/off the DMO, to select a reticle, to select the right zoom, to display warning sign for laser detection and to control brightness of the head mount display (HMD) 1242. Using a control box module 1210, a user can easily select a desired reticle and a magnification for maximum flexibility and increased performance in the field. The control box module 1210 provides an ability to switch in a split second from Close Quarters Battle setting to a semi-sniping setting and vice versa. In addition, it can be used as a discrete target observation and identification device.

In embodiments of the invention, the control box 1210 allows users to store video images to a fixed or removable storage device for after action review or training purpose.

Captured high quality video images are displayed in real time on the user's eye-piece or the head mounted display (HMD). In addition, the head mount display (HMD) 1242 can display selected reticle, magnification and Laser detection or warning. The HMD allows the shooter to remain under or behind a crew served infantry weapon during battlefield conditions and still effectively engage enemy targets.

In embodiments of the invention, the digital machinegun optic (DMO) 1200 may be connected to (or communicate with) the head mounted display (HMD) 1242 via wireless technology. A power to the HMD may be provided by a dedicated battery pack. A power to the DMO may be provided by a separate battery pack or from a vehicle power supply.

Although example embodiments have been described with reference to a number of illustrative examples, it should be understood that numerous other modifications and changes can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A universal machinegun optic (UMO) with a modular design, the UMO comprising:

an optical module that provides a user an aimpoint in a form of an illuminated red dot; and a bullet drop compensation mount receiving the optical module in a detachable manner, and having a mounting solution, a caliber adjustment knob configured to enable a user to select a caliber that matches firearm of different calibers, and a dual bullet drop compensation wheel to allow the user to accurately hit a target by selecting a right distance to the target.

2. The UMO of claim 1, wherein the mounting solution comprises a plurality of bolts configured to attach the UMO to the firearms of different calibers.

3. The UMO of claim 2, wherein the different calibers include 5.56 mm, 7.62 mm, 8.6 mm, 12.7 mm, and 20 mm calibers.

4. The UMO of claim 3, wherein the caliber adjustment knob is a dual caliber selector that adjusts between 5.56 mm and 7.62 mm calibers, 7.62 mm and 12.7 mm calibers, and 12.7 mm and 20 mm calibers.

5. The UMO of claim 1, wherein the caliber adjustment knob is a dual caliber selector that adjusts between any two calibers chosen from 5.56 mm, 7.62 mm, 8.6 mm, 12.7 mm, and 20 mm calibers.

6. The UMO of claim 1, wherein the dual bullet drop compensation wheel corresponds to one set of two calibers, and is exchangeable with another dual bullet drop compensation wheel corresponding to another set of two calibers.

7. The UMO of claim 1, wherein the bullet drop compensation mount includes an attachment rail configured to receive one of the optical module, a digital module, and a thermal camera module for attachment.

8. The UMO of claim 1, further comprising at least one rail to receive at least one of a dazzler laser, a flash light, a laser range finder, and a laser pointer.

9. The UMO of claim 1, wherein the UMO is a universal machine gun optic enabling use of one machinegun optic for all medium and heavy machineguns using the dual bullet drop compensation wheel.

* * * * *